US005454320A

United States Patent [19]

Hilden et al.

[11] Patent Number: 5,454,320

[45] Date of Patent: Oct. 3, 1995

[54] AIR BAG INITIATOR

[75] Inventors: Lynn G. Hilden, Hollister; Charles J. Piper, III, Pleasant Hill; David Whang, San Jose; Mark L. Avory, Los Altos; Theodore J. Netoff, Milpitas, all of Calif.

[73] Assignee: Quantic Industries, Inc., San Carlos, Calif.

[21] Appl. No.: 965,913

[22] Filed: Oct. 23, 1992

[51] Int. Cl.[6] ..... F42C 19/12

[52] U.S. Cl. ..... 102/202.7; 102/202.9; 102/202.14

[58] Field of Search ..... 102/202.7, 202.9, 102/202.14, 202.5, 202.8, 202.2, 202.1

[56] References Cited

U.S. PATENT DOCUMENTS

| | | | |
|---|---|---|---|
| 2,695,563 | 11/1954 | Mulqueeny . | |
| 3,059,576 | 10/1962 | Haefner . | |
| 3,101,669 | 8/1963 | Gatley et al. . | |
| 3,198,117 | 8/1965 | Purdy et al. . | |
| 3,306,202 | 2/1967 | Menichelli et al. . | |
| 3,351,012 | 11/1967 | Wilson . | |
| 3,414,292 | 12/1968 | Oldberg et al. . | |
| 3,541,961 | 11/1970 | Larson . | |
| 3,557,699 | 1/1971 | Hubbard . | |
| 3,572,247 | 3/1971 | Warshall . | |
| 3,640,224 | 2/1972 | Petrick et al. . | |
| 3,695,179 | 10/1972 | Rainone et al. . | |
| 3,867,885 | 2/1975 | Gawlick et al. . | |
| 3,906,858 | 9/1975 | Craig et al. . | |
| 3,971,320 | 7/1976 | Lee | 102/202.9 |
| 4,040,356 | 8/1977 | Voreck, Jr. et al. . | |
| 4,110,813 | 8/1978 | Hoheisel et al. | 361/248 |
| 4,128,058 | 12/1978 | Mixon, Jr. et al. . | |
| 4,170,939 | 10/1979 | Hoheisel et al. . | |
| 4,220,088 | 9/1980 | Kimura et al. . | |
| 4,261,263 | 4/1981 | Coultas et al. | 102/203 |
| 4,271,453 | 6/1981 | Yajima et al. | 102/202.2 |
| 4,299,167 | 11/1981 | Bryan | 102/202.3 |
| 4,306,499 | 12/1981 | Holmes | 102/202.9 |
| 4,307,663 | 12/1981 | Stonestrom | 102/202.8 |
| 4,316,412 | 2/1982 | Dinegar et al. | 102/202.7 |
| 4,422,381 | 12/1983 | Barrett | 102/202.2 |
| 4,592,280 | 6/1986 | Shores | 102/202.2 |
| 4,616,565 | 10/1986 | Reinovsky | 102/202.7 |
| 4,621,578 | 11/1986 | Vallieres et al. | 102/202.9 |
| 4,648,319 | 3/1987 | Westerlund et al. | 102/202.12 |
| 4,696,231 | 9/1987 | Bryan | 102/202.5 |
| 4,729,315 | 3/1988 | Proffit et al. | 102/202.9 |
| 4,959,011 | 9/1990 | Nilsson | 102/202.9 |
| 5,036,768 | 8/1991 | Dow et al. | 102/202.2 |
| 5,044,278 | 9/1991 | Campbell | 102/202.8 |
| 5,054,395 | 10/1991 | Vetter et al. | 102/202.9 |
| 5,099,762 | 3/1992 | Drapala | 102/202.1 |
| 5,140,906 | 8/1992 | Little II | 102/202.14 |
| 5,243,492 | 9/1993 | Marquit et al. | 102/202.9 |

FOREIGN PATENT DOCUMENTS

| | | | |
|---|---|---|---|
| 960186 | 6/1964 | United Kingdom | 102/202.5 |

*Primary Examiner*—Stephen M. Johnson
*Attorney, Agent, or Firm*—Burns, Doane, Swecker & Mathis

[57] ABSTRACT

An air bag initiator including a main body and squib. The squib includes a charge mounted in a charge holder, a header press fitted onto the charge holder and a cup welded to the header. The squib also includes first and second lead pins and a bridgewire. A cap snap fits onto the main body and holds the squib in place during subsequent assembly operations. Ferrite beads for frequency attenuation and potting material are located in a cavity of the main body. The first lead is mounted off center in a bore passing through the header to allow bridgewires of different lengths to be used with the same header design. The cup includes a depression to maintain a single explosive powder charge under pressure and in contact with the bridgewire. An outer cup can be welded to the housing and an insulating cup can be provided between the cup of the squid and the outer cup to provide enhanced hermetic sealing of the charge and prevent current from passing between the cups.

17 Claims, 2 Drawing Sheets

AIR BAG INITIATOR

BACKGROUND

1. Field of the Invention

The invention relates to an airbag initiator which includes a squib for electrically igniting an explosive composition.

2. Description of Related Art

Various initiators are known in the art for electrically exploding an ignitable explosive composition ("charge"). For instance, FIG. 1 shows a conventional initiator 100 which includes casing 101, lead pins 102, 103, header 104, glass seal 105, ceramic chip 106, charge holder 107, first charge 108, air gap 109, second charge 110, cup 111 and insulating liner 112 inside cup 111.

FIG. 2 shows an initiator disclosed in U.S. Pat. No. 5,099,762 ("the '762 patent"). The initiator 200 includes casing 201, a pair of terminal pins 202, 203, bridgewire 204 connected between terminal pin 202 and header 205. Header 205 is also connected to the other terminal pin 203. The '762 patent discloses that the casing contains ignition charge 206 adjacent the bridgewire and output charge 207 which is adjacent to but axially spaced from the ignition charge. According to the '762 patent, the bridgewire is sandwiched between ceramic chip 208 and the ignition charge and glass seal 209 is adjacent the ceramic chip. The ceramic chip and the glass seal are located in a bore through the header and lead pin 202 is centered in the bore. RF attenuating means 210 surrounds the lead pins and splices 211, 212 connect the lead pins to leads 213, 214.

Conventional initiators typically utilize an arrangement of parts wherein a spark gap is provided, a lead pin is centered in a bore extending through a header, the bore in the header includes a ceramic heat sink sandwiched between the charge and a glass-to-metal seal, the charge includes two or more explosive compositions in contact with each other or separated by an air gap therebetween, and/or the charge is located within a cap which does not press the charge against the bridgewire. Such arrangements present various drawbacks.

In arrangements which have a lead pin centered in a bore through the header, it is necessary to change the header design to accommodate bridgewires of different lengths thus requiring the expense of separate designs, manufacture and assembly of such different header designs. Accordingly, there is a need in the art for an initiator wherein the same header design can accommodate bridgewires having different lengths.

In arrangements in which the cup of the squib does not press the charge against the bridgewire, there is the danger of misfiring due to inadequate contact between the bridgewire and the charge. Accordingly, there is a need in the art for an initiator design which provides constant pressure on the loaded powder charge to maintain contact of the charge and bridgewire after assembly operations, shipment and installation of the igniter in an air bag system.

In arrangements which use a ceramic heat sink, the provision of such a part and assembly thereof add to the cost of manufacturing the igniter. In order to produce a more economical igniter, it would be desirable to eliminate as many assembly operations as possible and construct the igniter with as few parts as possible. Thus, an igniter which includes fewer parts, such as an igniter without a ceramic heat sink should be more economical to produce.

SUMMARY OF THE INVENTION

The invention provides an electro-explosive initiator which includes a tubular housing having an opening therein extending in an axial direction, an explosive charge supported by the housing, a bridgewire supported by the housing for igniting the explosive charge in response to an electric current passing through the bridgewire, and first and second electrical current paths in electrical contact with the bridgewire for supplying an electric current to the bridgewire. The charge preferably comprises a single charge of homogeneous powder composition which is maintained under pressure and in contact with the bridgewire.

According to one aspect of the invention, a header is supported by the housing for conducting heat away from the bridgewire. The header is in electrical contact with the first electrical current path and has a bore therein extending in the axial direction. The second electrical current path extends through the bore and is electrically insulated from the header. The second electrical current path is closer to one side of the bore than an opposite side of the bore. This allows the same header design to be used with bridgewires having different lengths.

According to another aspect of the invention, a glass insulator electrically insulates the second electrical current path from the header and the glass insulator forms a glass-to-metal seal in the bore. In addition, the glass insulator is in contact with the explosive charge to provide a heat sink. With this arrangement, the conventional ceramic disc heat sink is not used thereby reducing the number of parts and assembly steps required for the initiator.

According to still another aspect of the invention, a cup surrounds the header and explosive charge. The cup has an open end thereof hermetically sealed to the header and includes at least one depression therein. The depression biases the explosive charge against the bridgewire to enhance ignition of the explosive charge when current above a threshold value passes through the bridgewire. This arrangement provides enhanced reliability since the charge is maintained under pressure and in good contact with the bridgewire even after assembly operations and installation of the initiator. In addition, the powder charge will be less affected by vehicle vibration.

The initiator can include several other features. For instance, the initiator can include a charge holder which is tubular in shape and press fitted onto the header. The charge holder includes a bore therein in which the charge is located. Radio frequency attenuating means can be provided in the initiator. In particular, the first and second electrical current paths can include first and second lead pins and the attenuating means can comprise at least one bead of radio frequency attenuating material such as ferrite surrounding the first and second lead pins. The lead pins can include an electrically insulating coating to prevent electrical current from passing between the lead pins and the ferrite beads. A potting compound is preferably provided within a cavity of the housing. The cavity of the housing can include at least one notch therein and the potting compound can extend into the notch to aid retention of the potting compound upon detonation of the charge.

Other features which can be included in the initiator relate to hermetic sealing of the charge. In particular, the initiator can include an inner metal cup encasing the header, the charge and the bridgewire. An insulating cup of electrically non-conductive material can surround the inner metal cup and an outer metal cup can surround the insulating cup. The inner metal cup can be welded to the header and the outer metal cup can be welded to the housing. Thus, the insulating cup can prevent electrical current from passing between the inner and outer metal cups.

To aid manufacture of the initiator, a cap can be provided to hold the squib in position on the housing. In particular, the cap can comprise a nylon sleeve which surrounds the cup/header assembly. The cap can include attachment means for snap-fitting the cap onto the housing.

DETAILED DESCRIPTION OF THE PREFERRED EMBODIMENTS

The invention provides an air bag initiator which has advantages over conventional initiators. In particular, the initiator according to the invention incorporates at least one or more of the following features: (1) the lead pin is arranged off center in the glass insulator to permit a variety of bridgewire lengths to be used with the same header design; (2) a glass insulator in a bore through the header which performs a dual function of an insulator for a lead pin and a heat sink in contact with the bridgewire thereby obviating the need for a ceramic heat sink; (3) the charge is maintained under pressure and pressed against the bridgewire by a spring design of the cup; (4) a cap which snap fits onto the housing to encase the squib during assembly of the initiator; (5) a squib having only a single weld; (6) the explosive charge powder is a single charge of uniform composition; (7) the charge is held in a charge holder which is press fit onto the header; (8) electrostatic discharge protection is provided by isolating both lead pins of a two pin design wherein one pin is ground and the other pin is hot; and (9) a low leak rate due to one or more high quality hermetic seals.

The air bag initiator according to the invention can be built at low cost in high volume due to use of a minimal number of parts which can be easily assembled. For instance, the squib requires only one weld and a single charge pressing. The bridgewire can be welded ultrasonically to the header and the glass insulator and header can be effectively used as a heat sink in order to avoid use of the additional ceramic disc heat sink which is typically used in conventional squib arrangements. In addition, the cup can be hermetically sealed to the header by a single TIG weld and the closed end of the cup can include a depression which places the charge under pressure and in contact with the bridgewire. The initiator according to the invention can also include locking mechanisms to aid in assembly and provide parts retention upon detonation of the charge.

Figure 3:
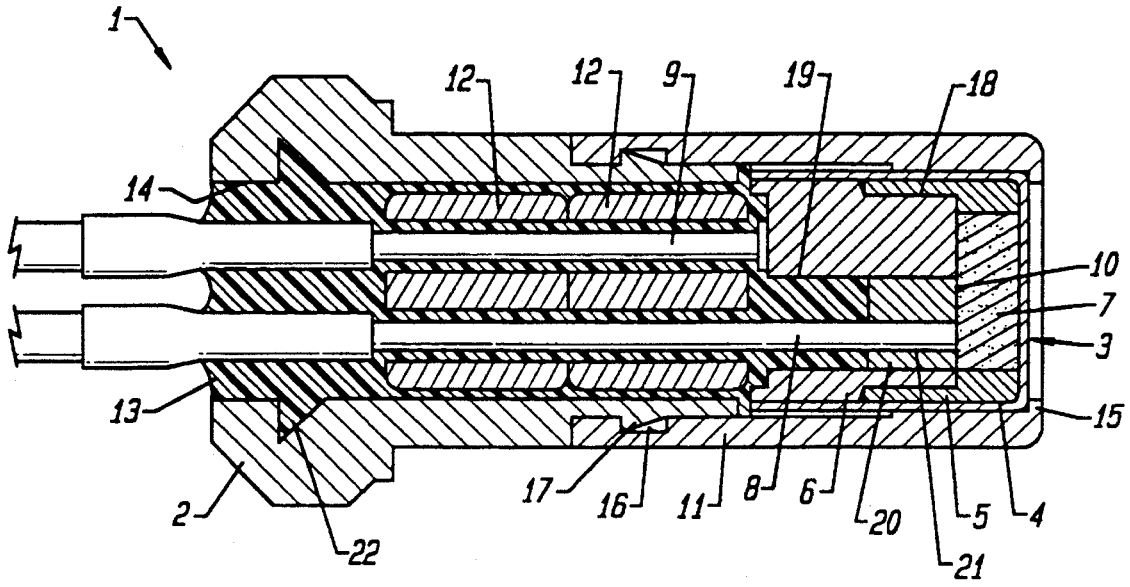
FIG. 3 is a longitudinal cross sectional view of a first embodiment of an airbag initiator according to the present invention.

An air bag initiator according to a first embodiment of the invention is shown in FIG. 3. The airbag initiator 1 includes main body or housing 2 and squib 3. Squib 3 includes cup 4, charge holder 5, header 6, charge 7, first lead 8, second lead 9 and bridgewire 10. Cap 11 snap fits onto main body 2 and can be used to hold squib 3 in place during subsequent assembly operations. Beads 12 for frequency attenuation and potting material 13 are located in cavity 14 of main body 2. Initiator 1 can be extremely small in size, e.g., length less than 1.25 inch and diameter less than 0.5 inch.

Main body 2 is generally tubular in shape and acts as a heat sink. Main body 2 can be formed of a rigid material such as a pure metal or metal alloy, preferably aluminum or an aluminum alloy. Cavity 14 extends in an axial direction through main body 2 and a rear part of main body 2 is thicker than the rest of main body 2.

Cap 11 is tubular in shape and surrounds squib 3. Cap 11 can be open at both ends with flange 15 extending radially inwardly at one end thereof for engaging a front end of cup 4. The other end of cap 11 includes attachment means for snap fitting cap 11 to one end of main body 2. Alternatively, cap 11 can be a non-removable sleeve of plastic which is injection molded directly around cup 4 and a front part of main body 2. In either case, it is thus possible to provide an initiator with a uniform diameter forward of a rear portion of main body 2. If desired, cap 11 can be omitted in its entirety, in which case cup 4 will be exposed.

Cap 11 can be of a non-conducting material such as plastic or NYLON. Cap 11 can be mechanically attached to main body 2 by means of a groove 16 located on an inner surface of cap 11 and a projection 17 located on an outer surface of main body 2 or vice versa. Projection 17 and groove 16 preferably extend continuously about main body 2 and cap 11, respectively, so as to provide a highly reliable, fast-acting connection between cap 11 and main body 2.

Charge 7 is contained by cup 4, which can be hermetically sealed to header 6. Cup 4 is tubular in shape and closed at one end. Charge holder 5 fits within the closed end of cup 4. Charge holder 5 is generally ring shaped and includes a central hole which is stepped to form a smaller bore for containing charge 7 and a large bore 18 which is press fitted onto header 6. Charge 7 is pressed into the smaller portion of the central hole of charge holder 5 with a paper or Mylar disc between the charge and the inner surface of cup 4. Charge 7 can be a single charge such as a uniform composition of an explosive powder such as zirconium/potassium perchlorate ($Zr/KC10_4$) capable of detonation upon heating or igniting.

Header 6 and charge holder 5 fit within cup 4 such that charge 7 is pressed between an end of cup 4 and an end of header 6. The outer periphery of header 6 is stepped such that a larger diameter portion thereof engages an inner wall of cup 4 and a smaller diameter portion thereof engages an inner surface of larger bore 18 of charge holder 5. Header 6 and cup 4 are preferably of metal such as stainless steel or nickel and are welded together to form a hermetic seal therebetween which protects charge 7 from exposure to moisture.

Header 6 includes bore 19 extending axially therethrough. Insulator 20 such as glass fills at least a portion of bore 19 and provides a hermetic seal such as a glass-to-meal seal therein. Thus, charge 7 is held between header 6, charge holder 5, cup 4 and insulator 20. Contrary to the conventional arrangements shown in FIGS. 1 and 2 wherein a ceramic material separates the charge from the glass seal, the present invention omits the ceramic material and instead provides the glass insulator 20 such that it supports charge 7 and bridgewire 10.

First lead 8 extends through opening 21 in insulator 20 and bridgewire 10 extends between first lead 8 and header 6. Contrary to the conventional arrangements shown in FIGS. 1 and 2 wherein a lead pin is centered in a bore of a header, first lead 8 is preferably located eccentrically in bore 19 to allow for use of bridgewires of different affective lengths depending upon which side of the bore the bridgewire attaches to header 6. For instance, bridgewires of shorter lengths can be used to connect first lead 8 with the closer portion of header 6 or bridgewires having longer lengths can used to connect first lead 8 to the portion of header 6 located furthest from first lead 8.

Second lead 9 is a ground wire which extends through main body 2 and is electrically connected to header 6. On the other hand, first lead 8 is a hot wire which extends through main body 2, bore 19 and opening 21 terminating adjacent to charge 7. Bridgewire 10 electrically connects header 6 to first lead 8 and preferably is welded to header 6 to form the connection. Second lead 9, header 6, bridgewire 10 and first lead 8 thus form an electrically conductive circuit with bridgewire 10 in thermal conducting relationship with charge 7. When a current above a threshold voltage is applied to the circuit, bridgewire 10 is heated by resistance heating to a temperature sufficient to trigger the detonation of charge 7. To prevent accidental or unintentional detonation, glass insulator 20 and header 6 provide a heat sink in contact with bridgewire 10 for drawing heat away from bridgewire 10.

Cup 4 is constructed so as to permit the energy of detonation to burst through the part of cup 4 facing charge 7. For instance, the end surface of cup 4 can be scored with a criss-cross pattern so that pedalling will occur and prevent fragmentation during detonation of charge 7. Alternatively, or in addition thereto, the end of cup 4 can be provided with one or more indentations or any suitable shape which biases charge 7 against bridgewire 10 thereby providing increased reliability of detonation of charge 7 upon heating of bridgewire 10.

In order to prevent accidental detonation of charge 7, one or more sleeves 12, made of frequency attenuating material, preferably ferrite beads, surround first and second leads 8 and 9. If sleeves 12 are of an electrically conductive material, it is preferable to provide electrical insulation between the sleeves 12 and the leads. For instance, the leads can be coated with PARALENE. Sleeves 12 act to shield the leads from external radio wave sources such as cellular telephones, CB's, HAM radios, etc. to prevent electrical signals from activating charge 7. For instance, the sleeves 12 can be of Type 73, 61 or 65 made by Fair-Rite Products Corp, Wallkill, N.Y. Type 73 is most effective for frequencies below 50 mHz and Types 61 and 65 are most effective above 50 mHz. Thus, Types 61 and 73 can be used together to cover the widest band of frequencies. Other materials which can be used alone or in combination are Types B, K or J of Ferronics Inc.

Figure 1:
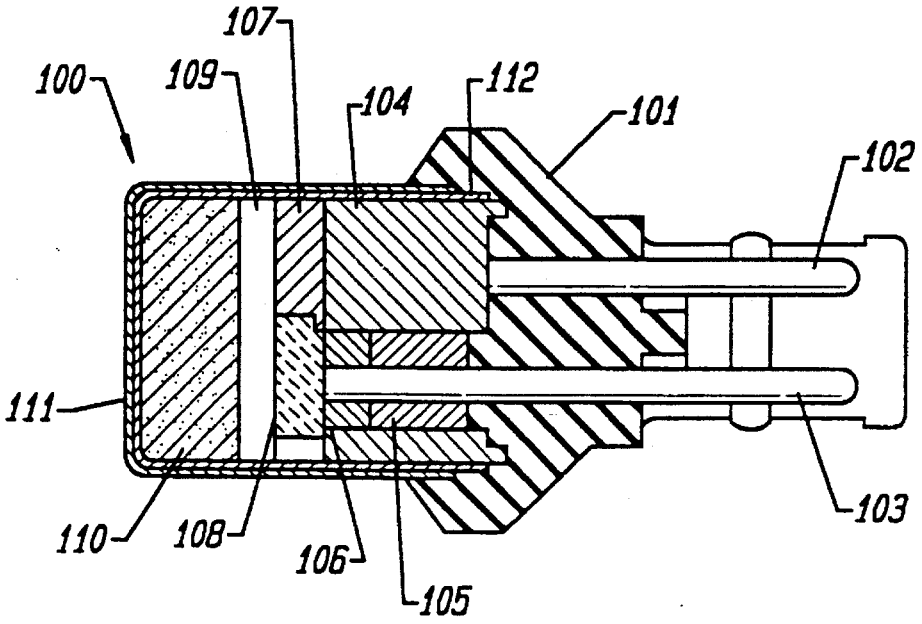
FIG. 1 is a longitudinal cross sectional view of a conventional initiator.
Figure 2:
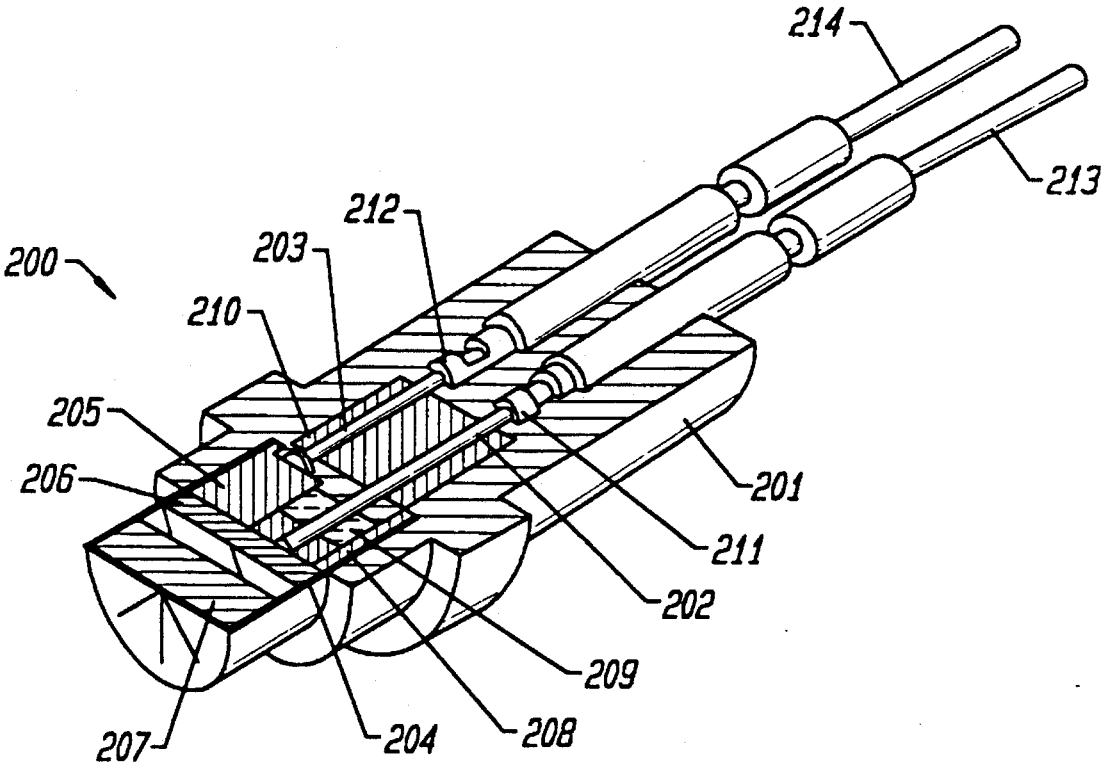
FIG. 2 is a perspective view of a longitudinal cross section of another conventional initiator.

In manufacturing the initiator shown in FIG. 1, an assembly including leads 8, 9, header 6, insulator 20, bridgewire 10, charge holder 5, charge 7 and cup 4 is placed within cap 11 and cap 11 is snap-fitted onto one end of main body 2 such that leads 8 and 9 extend out of the other end of the main body 2. Next, ferrite beads 12 are slid along leads 8 and 9 adjacent to but spaced from header 6. The leads should be electrically insulated from the ferrite beads but the header may or may not be in electrical contact with the ferrite beads and/or the main body. Then, potting material 13 is injected into main body 2 so as to fill empty spaces within main body 2. Potting material 13 preferably comprises a material that hardens to a rigid, electrically non-conductive state, such as epoxy, and functions to seal cup 4 within cap 11 and integrate the squid with main body 2. Potting material 13 also hermetically seals the end of main body 2 and cements the interior elements of the initiator assembly in place to prevent their movement.

Notch 22 is located on the interior surface of main body 2. Notch 22 can be triangular in cross-section and extend entirely around the inner periphery of cavity 14. As shown in FIG. 1, potting material 13 fills notch 22, and when the potting material hardens, the potting materials and the notch cooperate to provide blow-out prevention means to prevent longitudinal movement of the interior elements of the initiator assembly. This is advantageous during detonation of the charge to help contain and direct the force of the detonation in the desired direction. Header 6 can have an outer diameter larger than the diameter of cavity 14 as an additional blow-out prevention means. In such a case, the detonation force would cause header 6 to engage main body 2 rather than travel through cavity 14.

Figure 4:
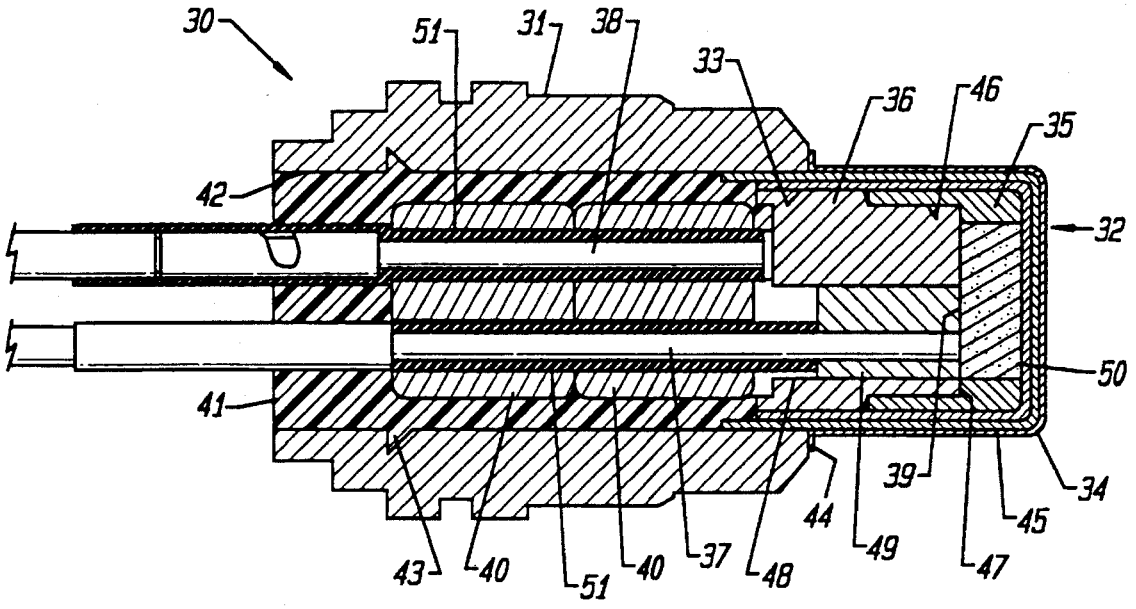
FIG. 4 is a longitudinal cross sectional view of a second embodiment of an airbag initiator according to the present invention.

A second embodiment of the present invention is illustrated in FIG. 4. According to the second embodiment, airbag initiator 30 includes main body or housing 31 and squib 32. Squib 32 includes inner cup 33, charge holder 35, header 36, charge 50, first lead 37, second lead 38 and bridgewire 39. Inner cup 33 is supported partially within one end of main body 31 and outer cup 34 encases inner cup 33. Beads 40 for frequency attenuation and potting material 41 are located in cavity 42 of main body 31. Initiator 30 can be about the same size as initiator 1.

Main body 31 is formed of a rigid material such as aluminum, aluminum alloy, stainless steel or other metals or metal alloys. Main body 31 is generally tubular in shape and interior cavity 42 extends longitudinally therethrough. Cut into the interior wall of the main body near one end is a notch 43. Outer cup 34 is generally tubular in shape and closed at one end. A radially outwardly extending lip 44 is located at the open end of outer cup 34. Outer cup 34 is fastened to main body 31 by bonding lip 44 to main body 31 to form a hermetic seal therebetween. The bond is preferably formed by TIG welding, in which case outer cup 34 is formed of a metal compatible to that of main body 31 to permit welding.

Insulating cup 45 is located between inner cup 33 and outer cup 34. Insulating cup 45 is snugly fitted within outer cup 34 with the open ends of outer cup 34 and insulating cup 45 facing the same direction. The open end of insulating cup 45 extends into and fits snugly within cavity 42 of main body 31. As can be seen in FIG. 4, insulating cup 45 prevents an electrical current from passing between inner cup 33 and main body 31 or between the inner and outer cups. In addition, this arrangement provides a high quality hermetic seal to prevent moisture from penetrating into charge 50.

Inner cup 33 is generally cylindrically shaped with an open end and a closed end and is snugly fitted within insulating cup 45 with the open ends of both facing the same direction. The closed end of inner cup 33 is shaped to provide a compressive force acting against powder charge 50 to maintain charge 50 in contact with bridgewire 39. Inner cup 33 can be formed of a thin, electrically conductive material and is preferably a metal such as steel to allow welding of inner cup 33 to header 36 thereby providing a hermetic seal therebetween.

Charge holder 35 is press fitted onto header 36 and fits within inner cup 33 at the closed end thereof. Charge holder 35 is tubular in shape with a stepped bore therein. A larger part 46 of the bore surrounds header 36, a smaller part of the bore surrounds charge 50 with shoulder 47 of the bore pressed against an end of header 36. Charge 50 is preferably a single uniform composition of explosive powder capable of detonation upon resistance heating of bridgewire 39.

Header 36 is a generally cylindrically shaped element having a flat face on the end thereof facing charge 50. Eccentric bore 48 extends axially through header 36 such that a central axis of header 36 is offset laterally from a central axis of bore 48. The outer periphery of header 36 includes smaller diameter male portion which fits within larger bore 46 of charge holder 35. Header 36 is snugly fitted into inner cup 33 such that the open end of inner cup 33 terminates adjacent one end of header 36. Insulator 49 fits within bore 48 and first lead 37 extends through insulator 49 such that an end of first lead 37 is coplanar with the end face of header 36. Insulator 49 provides a seal between first lead 37 and an inner periphery of bore 48. Preferably, insulator 49 is of glass which provides a glass-to-metal seal between first lead 37 and header 36.

Second lead 38 is a ground wire which extends longitudinally from the open end of main body 31 and is electrically connected with header 36. First lead 37 is a hot wire which extends longitudinally from the open end of main body 31 and through insulator 49 such that a central axis of first lead 37 is laterally offset from a central axis of bore 48. First and second leads 37, 38 can be of a single piece of wire or each can comprise several interconnected parts. First and second leads 37, 38 can include electrically insulating coatings 51 and one or more radio frequency attenuating beads 40 can be provided as in the first embodiment.

Bridgewire 39 connects first lead 37 and header 36 so that second lead 38, header 36, bridgewire 39 and first lead 37 form an electrically conductive circuit. Bridgewire 39 is formed of electrically resistive material and is in thermal contact with charge 50. Leads 37 and 38 are provided with terminals which extend from the open end of main body 31. A current above a threshold value flowing through the circuit will cause bridgewire 39 to heat or explode, which in turn initiates detonation of charge 50. The end walls of cups 33, 45 and 34 permit the release of the energy of the explosion therethrough. In addition, the ends of cups 33, 45 and 34 can be scored or otherwise formed to allow the material to petal rather than fragment. Charge holder 35, header 36 and insulator 49 form a rigid base which contains and directs the force of the explosion through the end walls of cups 33, 45 and 34.

As in the first embodiment, the eccentric position of first lead 37 in insulator 54 advantageously allows the selection of a bridgewire from a plurality of lengths to alter the detonation characteristics of initiator 30.

Potting material 41 is applied during assembly of initiator 30 coextensively to fill the empty spaces within cavity 42. Potting material 41 is composed of a material that hardens to a rigid, electrically non-conductive state, such as epoxy. Potting material 41 seals the open end of main body 31 and cements the interior elements of the initiator assembly in place to prevent their movement. As shown in FIG. 4, potting material 41 also seals the end of insulating cup 45 to the inner periphery of cavity 42.

As shown in FIG. 4, potting material 41 also fills notch 43, and when potting material 41 hardens, notch 43 provides a retaining force to prevent longitudinal movement of the interior elements of the initiator assembly during detonation of charge 50. This is advantageous during detonation of the charge to help contain and direct the force of the detonation in the desired direction.

It is to be understood that the invention is not limited to the foregoing description, which is by way of illustration and example only. Modifications, substitutions and additions may be made which are within the intended scope of the appended claims.

What is claimed is:

1. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being electrically insulated from the header, the second electrical current path being offset in the bore so as to be closer to one side of the bore than an opposite side of the bore; and a potting compound within a cavity of the housing, the housing including at least one notch therein opening into the cavity, the potting compound extending into the notch to aid retention of the potting compound upon detonation of the charge.

2. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being electrically insulated from the header, the second electrical current path being offset in the bore so as to be closer to one side of the bore than an opposite side of the bore; and an inner metal cup encasing the header, the charge and the bridgewire, an insulating cup of electrically non-conductive material surrounding the inner metal cup, and an outer metal cup surrounding the insulating cup, the inner metal cup being welded to the header and the outer metal cup being welded to the housing, the insulating cup preventing electrical current from passing between the inner and outer metal cups.

3. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being electrically insulated from the header, the second electrical current path being offset in the bore so as to be closer to one side of the bore than an opposite side of the bore; and a cap and a cup, the cup encasing the header, the bridgewire and the charge, the cap surrounding and supporting the cup, the cap including attachment means for snap-fitting the cap onto the housing.

4. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being electrically insulated from the header, the second electrical current path being offset in the bore so as to be closer to one side of the bore than an opposite side of the bore; and the first and second electrical current paths comprising first and second lead pins, at least one ferrite bead surrounding the lead pins, and each of the lead pins including a coating of an insulating material which prevents electrical current from passing between the lead pins and the ferrite bead.

5. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being electrically insulated from the header, the second electrical current path being offset in the bore so as to be closer to one side of the bore than an opposite side of the bore; and a cup encasing the header and a charge holder surrounding the charge, the charge consisting of a single homogeneous composition which contacts the bridgewire, an end of the header and an inner surface of a bore in the charge holder, the cup including an inner end surface pressing against the charge and maintaining the charge under pressure and in contact with the bridgewire.

6. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being in electrical contact with the bridgewire;

a glass insulator electrically insulating the second electrical current path from the header, the glass insulator forming a glass-to-metal seal in the bore and being in contact with the explosive charge; and a potting compound within a cavity of the housing, the housing including at least one notch therein opening into the cavity, the potting compound extending into the notch to aid retention of the potting compound upon detonation of the charge.

7. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being in electrical contact with the bridgewire;

a glass insulator electrically insulating the second electrical current path from the header, the glass insulator forming a glass-to-metal seal in the bore and being in contact with the explosive charge; and an inner metal cup encasing the header, the charge and the bridgewire, an insulating cup of electrically non-conductive material surrounding the inner metal cup, and an outer metal cup surrounding the insulating cup, the inner metal cup being welded to the header and the outer metal cup being welded to the housing, the insulating cup preventing electrical current from passing between the inner and outer metal cups.

8. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being in electrical contact with the bridgewire; and a cap and a cup, the cup encasing the header, the bridgewire and the charge, the cap surrounding and supporting the cup, the cap including attachment means for snap-fitting the cap onto the housing.

9. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being in electrical contact with the bridgewire;

a glass insulator electrically insulating the second electrical current path from the header, the glass insulator forming a glass-to-metal seal in the bore and being in contact with the explosive charge; and the first and second electrical current paths comprising first and second lead pins, the initiator further comprising at least one ferrite bead surrounding the lead pins, each of the lead pins including a coating of an insulating material which prevents electrical current from passing between the lead pins and the ferrite bead.

10. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction, the second electrical current path extending through the bore and being in electrical contact with the bridgewire;

a glass insulator electrically insulating the second electrical current path from the header, the glass insulator forming a glass-to-metal seal in the bore and being in contact with the explosive charge; and a cup encasing the header and a charge holder surrounding the charge, the charge consisting of a single homogeneous composition which contacts the bridgewire, an end of the header and an inner surface of a bore in the charge holder, the cup including an inner end surface pressing against the charge and maintaining the charge under pressure and in contact with the bridgewire.

11. An electro-explosive initiator, comprising:

a tubular housing having an opening therein extending in an axial direction;

an explosive charge supported by the housing;

a bridgewire supported by the housing for igniting the explosive charge in response to an electric current passing through the bridgewire;

first and second electrical current paths in electrical contact with the bridgewire for passing an electric current through the bridgewire;

a header supported by the housing for conducting heat away from the bridgewire, the header being in electrical contact with the first electrical current path and the bridgewire, the header having a bore therethrough extending in the axial direction and the second electrical current path passing through the bore;

a cup surrounding the header and explosive charge, the cup having an open end thereof hermetically sealed to the header, the cup including at least one depression therein, the depression biasing the explosive charge against the bridgewire to enhance ignition of the explosive charge when current above a threshold value passes through the bridgewire.

12. The initiator of claim 11, further comprising a charge holder, the charge holder being tubular in shape and press fitted onto the header, the charge holder including a bore therein in which the charge is located.

13. The initiator of claim 11, further comprising radio frequency attenuating means, the first and second electrical current paths including first and second lead pins, the attenuating means comprising at least one bead of radio frequency attenuating material surrounding the first and second lead pins.

14. The initiator of claim 11, further comprising a potting compound within a cavity of the housing, the housing including at least one notch therein opening to the cavity, the potting compound extending into the notch to aid retention of the potting compound upon detonation of the charge.

15. The initiator of claim 11, wherein the cup comprises an inner metal cup encasing the header, the charge and the bridgewire, the initiator further comprising an insulating cup of electrically nonconductive material surrounding the inner metal cup and an outer metal cup surrounding the insulating cup, the inner metal cup being welded to the header and providing a hermetic seal therebetween, the outer metal cup being welded to the housing and providing a hermetic seal therebetween, the insulating cup preventing electrical current from passing between the inner and outer metal cups.

16. The initiator of claim 11, further comprising a cap surrounding and supporting the cup, the cap including attachment means for snap-fitting the cap onto the housing.

17. The initiator of claim 11, wherein the first and second electrical current paths comprise first and second lead pins, the initiator further comprising at least one ferrite bead surrounding the lead pins, each of the lead pins including a coating of an insulating material which prevents electrical current from passing between the lead pins and the ferrite bead.

* * * * *